US008628829B2

(12) United States Patent
Uchiyama

(10) Patent No.: US 8,628,829 B2
(45) **Date of Patent: *Jan. 14, 2014**

(54) METHOD OF FORMING ORGANIC FILM, AND NOZZLE PLATE, INKJET HEAD AND ELECTRONIC DEVICE

(75) Inventor: Hiroki Uchiyama, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 304 days.

This patent is subject to a terminal disclaimer.

(21) Appl. No.: 12/893,936

(22) Filed: Sep. 29, 2010

(65) Prior Publication Data

US 2011/0074881 A1 Mar. 31, 2011

(30) Foreign Application Priority Data

Sep. 30, 2009 (JP) ..... 2009-227219

(51) Int. Cl.
*B05D 1/32* (2006.01)

(52) U.S. Cl.
USPC ..... 427/466

(58) Field of Classification Search
USPC ..... 427/497, 97.4, 107, 122, 466
See application file for complete search history.

(56) References Cited

U.S. PATENT DOCUMENTS

| | | | | |
|---|---|---|---|---|
| 5,372,851 | A | 12/1994 | Ogawa et al. | |
| 6,752,487 | B1 | 6/2004 | Kubota et al. | |
| 8,222,116 | B2 * | 7/2012 | Jinbo et al. | 438/458 |
| 8,362,473 | B2 * | 1/2013 | Nakatani et al. | 257/40 |
| 2005/0112365 | A1 | 5/2005 | Hayashida et al. | |
| 2009/0219335 | A1 | 9/2009 | Furukawa | |
| 2010/0126529 | A1 | 5/2010 | Seki et al. | |

FOREIGN PATENT DOCUMENTS

| | | |
|---|---|---|
| JP | 05-168913 | 7/1993 |
| JP | 10-041222 | 2/1998 |
| JP | 10-323984 | 12/1998 |
| JP | 2001-105597 | 4/2001 |
| JP | 2003-164379 | 6/2003 |
| JP | 2003-286478 | 10/2003 |
| JP | 2004-338223 | 12/2004 |
| JP | 2005-314741 | 11/2005 |
| JP | 2008-264783 | 11/2008 |
| JP | 2008-274016 | 11/2008 |
| JP | 2009-029068 | 2/2009 |
| JP | 2009-066798 | 4/2009 |
| JP | 2009-196293 | 9/2009 |

OTHER PUBLICATIONS

Office action mailed Jun. 25, 2013 in Japanese Patent Application No. 2009-227219 and partial translations, 7 pgs.
Office action mailed Jun. 25, 2013 in Japanese Patent Application No. 2009-227221 and partial translations, 9 pgs.

* cited by examiner

*Primary Examiner* — Lamson Nguyen
(74) *Attorney, Agent, or Firm* — Fish & Richardson P.C.

(57) ABSTRACT

The method of forming an organic film, includes: a preprocessing step including a plasma treatment step of carrying out plasma treatment to a surface of a base member, and an exposure processing step of exposing the surface of the base member that has undergone the plasma treatment, in an atmosphere containing at least water; and an organic film formation step of thereafter forming an organic film on the surface of the base member using a silane coupling agent.

14 Claims, 8 Drawing Sheets

METHOD OF FORMING ORGANIC FILM, AND NOZZLE PLATE, INKJET HEAD AND ELECTRONIC DEVICE

BACKGROUND OF THE INVENTION

1. Field of the Invention

The present invention relates to a method of forming an organic film, and to a nozzle plate, an inkjet head and an electronic device, and more particularly to technology for forming an organic film using a silane coupling agent.

2. Description of the Related Art

An organic film using a silane coupling agent can be formed on various base members, and therefore is applied in a wide range of fields. In the field of inkjet technology, a film of this kind is used when forming a liquid-repellent film on the ejection surface of a nozzle plate, or when bonding two base members together, or the like, and beneficial effects are achieved in improving the ejection characteristics, the maintenance properties and the durability of the head.

A monomolecular film or polymerized film using a silane coupling agent is bonded to the base member through siloxane bonds (Si—O bonds). The siloxane bonds are liable to be hydrolyzed in alkaline solutions, and upon contact with alkaline solutions, are liable to be erased from the base member. Hence, there is a problem in that durability is poor in respect of alkaline solutions.

In response to these problems, Japanese Patent Application Publication No. 2003-286478, for example, describes a liquid-repellent film made of a material which incorporates a substitute group that makes it harder for alkaline components to approach the vicinity of the siloxane bonds, and a substitute group having thermal resistance, with the object of providing the liquid-repellent film having high resistance to alkalis and high thermal resistance. Moreover, Japanese Patent Application Publication No. 2009-029068 is directed to a method of manufacturing a nozzle plate for liquid ejection having a liquid-repellent film arranged on a surface where ejection ports for ejecting the liquid are present, and describes a method of manufacturing a nozzle plate by activating the surface of a silicon substrate having a silicon oxide film by removing the surface by chemical reaction, and then activating by physical breakdown, and arranging a liquid-repellent film on the silicon oxide film.

However, even if the material properties of the liquid-repellent film are improved and durability in terms of resistance to alkalis is improved, as in Japanese Patent Application Publication No. 2003-286478, there is a drawback in that if the processing of the underlying layer is incomplete, then sufficient bonding sites (hydroxyl groups: OH groups) are not created. Then, the bonding between the liquid-repellent film and the underlying layer is not sufficient, and the film properties are declined. Moreover, even if the silicon oxide film of the underlying layer is subjected to the plasma treatment to remove organic material and the surface is cleaned and activated to strengthen the bond between the liquid-repellent film and the underlying layer as in Japanese Patent Application Publication No. 2009-029068, there is a drawback in that sufficient reaction sites are not created on the surface and a high-density liquid-repellent film having sufficient resistance to alkalis is not obtained.

SUMMARY OF THE INVENTION

The present invention has been contrived in view of these circumstances, an object thereof being to provide a method of forming an organic film which can coat a base member with high density and have high resistance to alkaline solutions, and a nozzle plate, an inkjet head and an electronic device.

In order to attain the aforementioned object, the present invention is directed to a method of forming an organic film, comprising: a pre-processing step including a plasma treatment step of carrying out plasma treatment to a surface of a base member, and an exposure processing step of exposing the surface of the base member that has undergone the plasma treatment, in an atmosphere containing at least water; and an organic film formation step of thereafter forming an organic film on the surface of the base member using a silane coupling agent.

According to this aspect of the present invention, since the plasma treatment and the exposure in the atmosphere containing water are performed as the pre-processing steps before forming the organic film on the surface of the base member using the silane coupling agent, it is possible to form reaction sites (hydroxyl groups) at high density on the surface of the base member. Therefore, when forming the organic film using the silane coupling agent on the surface of this base member, since the reaction sites have been formed at high density, it is then possible to apply the organic film with high density, and the organic film having high resistance to alkaline solutions can be formed.

Preferably, in the exposure processing step, the surface of the base member is exposed in a water vapor atmosphere.

According to this aspect of the present invention, by carrying out the exposure processing step in the water vapor atmosphere, it is possible to reduce the amount of surplus water left on the surface of the base member.

It is also possible that in the exposure processing step, the surface of the base member is immersed in water.

Preferably, the pre-processing step further includes a dehydration processing step of dehydrating the surface of the base member, following the exposure processing step.

According to this aspect of the present invention, by carrying out the dehydration processing step after the exposure processing step, it is possible to remove excess water remaining on the surface of the base member due to the exposure processing step. If water is left on the surface of the base member, then it becomes more difficult for the silane coupling agent and the base member to create siloxane bonds, and extremely instable bonds of low bonding force (hydrogen bonds) may occur. Therefore, by carrying out the dehydration processing step, it is possible to create siloxane bonds between the silane coupling agent and the base member, and the organic film having high durability can be formed.

Preferably, in the dehydration processing step, a purging process is carried out with a gas containing at least a rare gas.

It is also preferable that in the dehydration processing step, a purging process is carried out with a gas containing at least $N_2$.

It is also possible that in the dehydration processing step, the surface of the base member is exposed in an atmosphere heated to a temperature not lower than 40° C., preferably not lower than 60° C., more preferably not lower than 100° C.

It is also possible to carry out the heating process after carrying out the purging with the gas.

Preferably, the surface of the base member is composed of at least silicon.

According to this aspect of the present invention, since the surface of the base member contains silicon, then it is possible to improve adhesion to the silane coupling agent. The fact that the surface of the base member contains silicon is not limited to a case where the whole of the base member is formed of a material containing silicon, and also includes a case where the surface portion of the base member is formed of a material containing silicon.

Preferably, in the plasma treatment step, the plasma treatment uses a reaction gas containing at least one of oxygen, a rare gas, hydrogen and nitrogen.

According to this aspect of the present invention, by using the above-described gases in the plasma treatment step, it is possible to prevent impurities from adhering to the surface of the base member.

Preferably, the organic film contains at least fluorine and has liquid-repellent properties.

According to this aspect of the present invention, since the organic film has liquid-repellent properties, then by using the organic film in a nozzle plate, for example, it is possible to prevent adherence of liquid droplets to the periphery of the nozzle holes, and therefore ejection stability can be improved.

It is also preferable that the method further comprises: an intermediate layer formation step of forming an intermediate layer constituted of a plasma polymerization film on the surface of the base member, following the pre-processing step and before the organic film formation step, wherein in the organic film formation step, the organic film is formed on the intermediate layer on the surface of the base member. Preferably, the method further comprises an oxidization processing step of carrying out oxidization of the intermediate layer, following the intermediate layer formation step and before the organic film formation step.

In order to attain the aforementioned object, the present invention is also directed to a nozzle plate comprising: a base member; and an organic film formed by the above-described method and having siloxane bonds with the base member. The present invention is also directed to an inkjet head comprising the nozzle plate. The present invention is also directed to an electronic device comprising the inkjet head.

Since the organic film can be formed by the above-described method at high density and with high resistance to alkalis, then it is desirable for use in the nozzle plate, the inkjet head and the electronic device.

According to the method of forming the organic film in the present invention, since the reaction sites (hydroxyl groups) can be formed at high density on the surface of the base member by the pre-processing step, then the organic film can be formed at high density and it is possible to form the organic film having high resistance to alkaline solutions. The organic film thus formed is desirable for use in a nozzle plate, an inkjet head, and an electronic device.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of Inkjet Recording Apparatus

Figure 1:
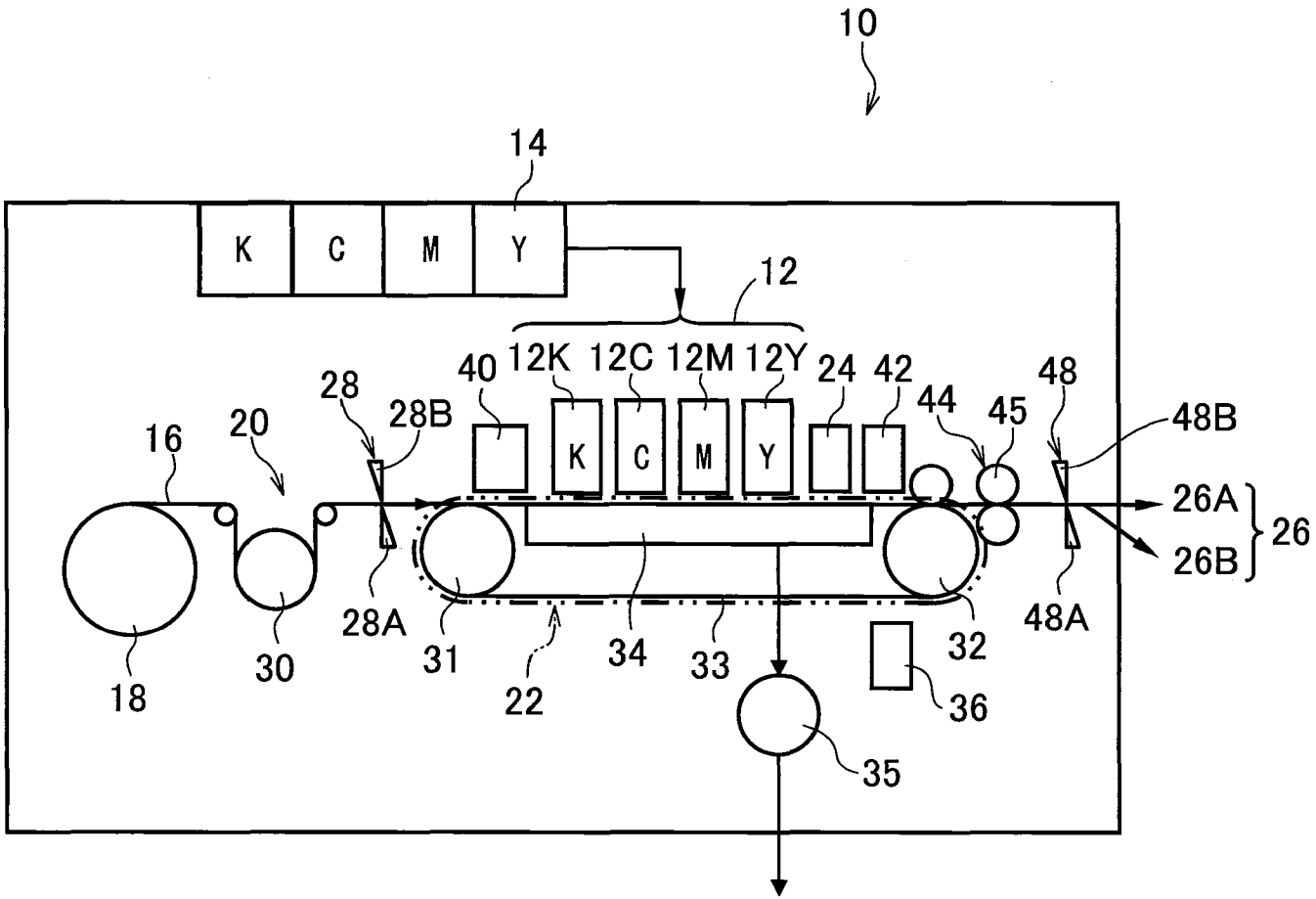
FIG. 1 is a general schematic drawing showing a general view of an inkjet recording apparatus.

FIG. 1 is a general configuration diagram of an inkjet recording apparatus according to an embodiment of the present invention. As illustrated in FIG. 1, the inkjet recording apparatus 10 includes: a printing unit 12 having a plurality of inkjet heads (hereafter, also simply called "heads") 12K, 12C, 12M, and 12Y provided for the respective ink colors of black (K), cyan (C), magenta (M) and yellow (Y); an ink storing and loading unit 14 for storing inks of K, C, M and Y to be supplied to the printing heads 12K, 12C, 12M, and 12Y; a paper supply unit 18 for supplying recording paper 16; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter 28 is provided as illustrated in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as illustrated in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, and a combination of these. In the case of the configuration in which the belt 33 is nipped with the cleaning rollers, it is preferable to make the line velocity of the cleaning rollers different from that of the belt 33 to improve the cleaning effect.

A roller nip conveyance mechanism, in place of the suction belt conveyance unit 22, can be employed. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
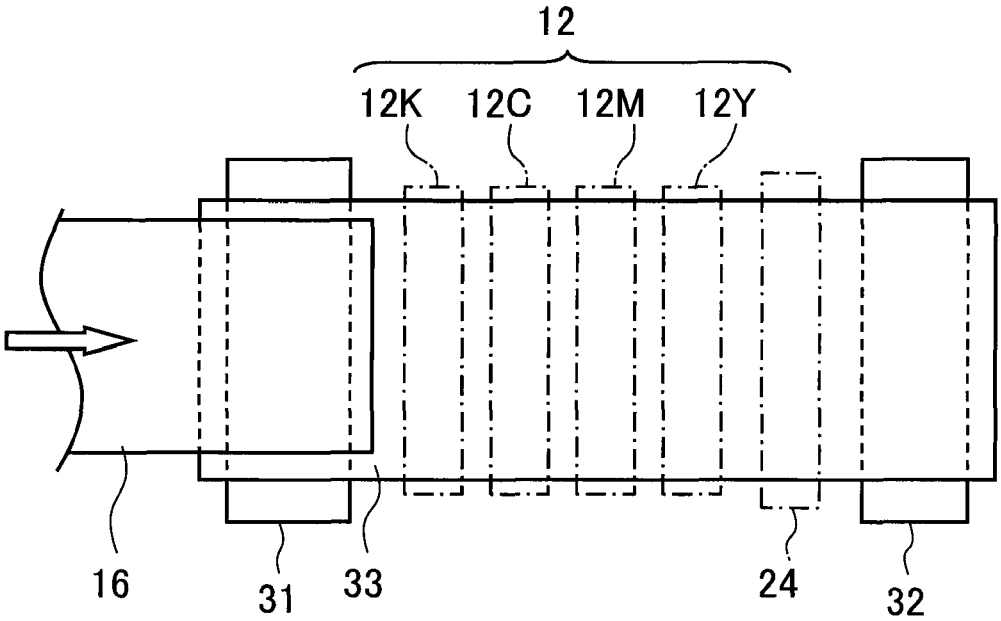
FIG. 2 is a principal part plan diagram of the periphery of a print unit of the inkjet recording apparatus in FIG. 1.

The printing unit 12 is a so-called "full line head" in which a line head having a length corresponding to the maximum paper width is arranged in a direction (main scanning direction) that is perpendicular to the paper conveyance direction (sub scanning direction). Each of the printing heads 12K, 12C, 12M, and 12Y constituting the printing unit 12 is constituted by a line head, in which a plurality of ink ejection ports (nozzles) are arranged along a length that exceeds at least one side of the maximum-size recording paper 16 intended for use in the inkjet recording apparatus 10 (see FIG. 2).

The printing heads 12K, 12C, 12M, and 12Y are arranged in the order of black (K), cyan (C), magenta (M) and yellow (Y) from the upstream side, along the feed direction of the recording paper 16 (hereinafter referred to as the "sub-scanning direction"). A color image can be formed on the recording paper 16 by ejecting the inks from the printing heads 12K, 12C, 12M, and 12Y, respectively, onto the recording paper 16 while conveying the recording paper 16.

By adopting the printing unit 12 in which the full line heads covering the full paper width are provided for the respective ink colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a head reciprocates in a direction (the main scanning direction) orthogonal to the paper conveyance direction.

Although the configuration with the KCMY four standard colors is described in the present embodiment, combinations of the ink colors and the number of colors are not limited to those. Light inks or dark inks can be added as required. For example, a configuration is possible in which heads for ejecting light-colored inks such as light cyan and light magenta are added. Furthermore, there are no particular restrictions of the sequence in which the heads of respective colors are arranged.

As illustrated in FIG. 1, the ink storing and loading unit 14 has tanks for storing the inks of K, C, M and Y to be supplied to the heads 12K, 12C, 12M, and 12Y, and the tanks are connected to the heads 12K, 12C, 12M, and 12Y by means of channels (not shown). The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the heads 12K, 12C, 12M, and 12Y for the respective colors, and the ejection of each head is determined. The ejection determination includes measurement of the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressing unit 44 is disposed following the post-drying unit 42. The heating/pressing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not illustrated in FIG. 1, the paper output unit 26A for the target prints is provided with a sorter for collecting prints according to print orders.

Structure of Head

Next, the structure of heads 12K, 12C, 12M and 12Y will be described. The heads 12K, 12C, 12M and 12Y of the respective ink colors have the same structure, and a reference numeral 50 is hereinafter designated to any of the heads.

Figure 3A:
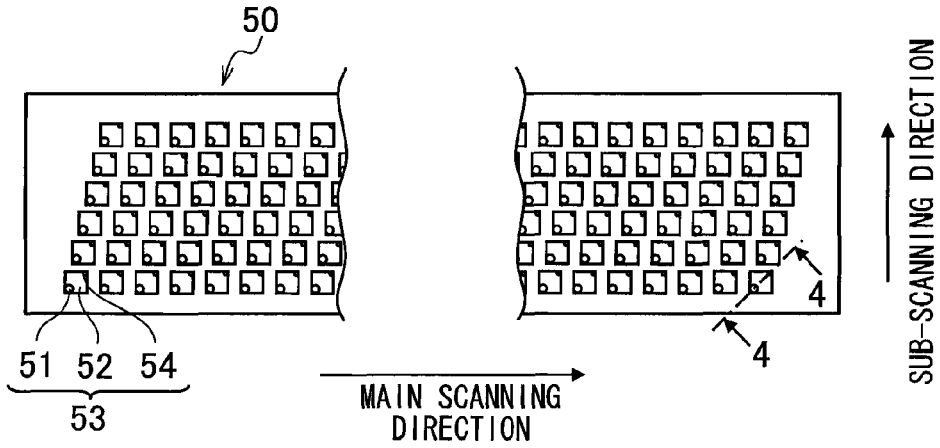
FIGS. 3A to 3C are plan view perspective diagrams showing embodiments of the composition of a head.
Figure 3B:
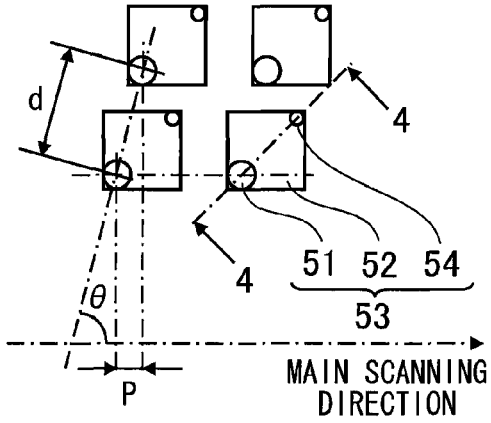
Figure 3C:
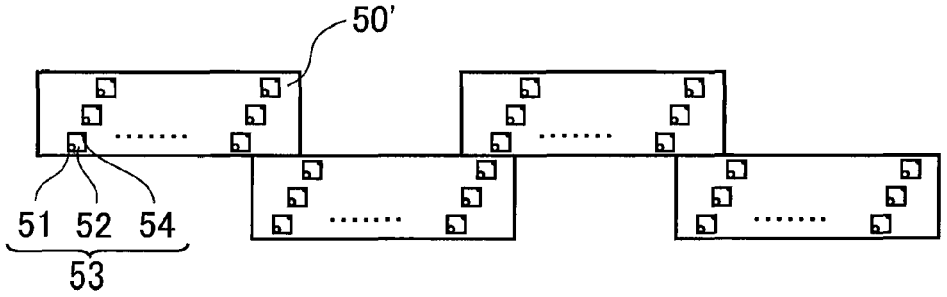
Figure 4:
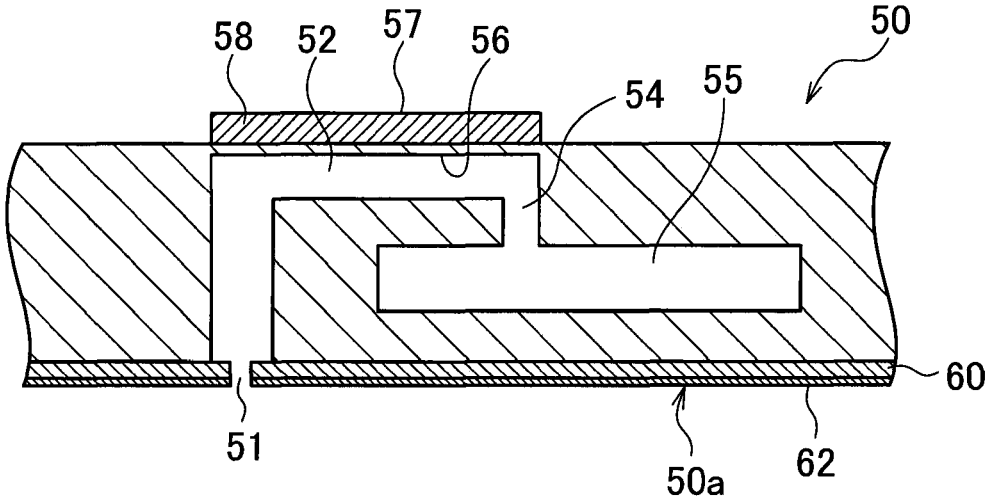
FIG. 4 is a cross-sectional diagram along line 4-4 in FIGS. 3A and 3B.

FIG. 3A is a plan perspective diagram showing an example of the structure of a head 50, and FIG. 3B is a partial enlarged diagram of same. Moreover, FIG. 3C is a plan view perspective diagram showing a further example of the structure of the head 50. FIG. 4 is a cross-sectional diagram showing the composition of an ink chamber unit (a cross-sectional diagram along line 4-4 in FIGS. 3A and 3B).

The nozzle pitch in the head 50 should be minimized in order to maximize the density of the dots formed on the surface of the recording paper. As illustrated in FIGS. 3A and 3B, the head 50 according to the present embodiment has a structure in which a plurality of ink chamber units 53, each having a nozzle 51 serving as an ink droplet ejection aperture, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the main scanning direction perpendicular to the paper conveyance direction) is reduced and high nozzle density is achieved.

The mode of forming one or more nozzle rows through a length corresponding to the entire width of the recording paper 16 in a direction substantially perpendicular to the paper conveyance direction is not limited to the example described above. For example, instead of the configuration in FIG. 3A, as illustrated in FIG. 3C, a line head having nozzle rows of a length corresponding to the entire width of the recording paper 16 can be formed by arranging and combining, in a staggered matrix, short head blocks (head chips) 50' having a plurality of nozzles 51 arrayed in a two-dimensional fashion. Furthermore, although not shown in the drawings, it is also possible to compose a line head by arranging short heads in one row.

As shown in FIG. 4, the nozzles 51 are formed in a nozzle plate 60, which constitutes an ink ejection surface 50*a* of the head 50. The nozzle plate 60 is made, for example, of a silicon-containing material such as Si, $SiO_2$, SiN or quartz glass, a metal material such as Al, Fe, Ni, Cu or an alloy containing these, an oxide material such as alumina or iron oxide, a carbon material such as carbon black or graphite, or a resin material such polyimide.

An organic film 62 having liquid-repellent properties with respect to ink is formed on the surface (ink ejection side surface) of the nozzle plate 60, thereby preventing adherence of ink. The method of forming the organic film 62 is described in detail below.

The head 50 is provided with the pressure chambers 52 correspondingly to the nozzles 51. The pressure chamber 52 is approximately square-shaped in planar form, and the nozzle 51 and a supply port 54 are arranged respectively at either corner on a diagonal of the pressure chamber 52. The pressure chambers 52 are connected to a common flow channel 55 through the supply ports 54. The common flow channel 55 is connected to an ink tank (not shown) serving as an ink supply source. The ink is supplied from the ink tank and distributed to the pressure chambers 52 through the common flow channel 55.

Piezoelectric elements 58 respectively provided with individual electrodes 57 are bonded to a diaphragm 56 which forms the upper face of the pressure chambers 52 and also serves as a common electrode, and each piezoelectric element 58 is deformed when a drive voltage is supplied to the corresponding individual electrode 57, thereby causing ink to be ejected from the corresponding nozzle 51. When the ink is ejected, new ink is supplied to the pressure chambers 52 from the common flow channel 55 through the supply ports 54.

In the present embodiment, the piezoelectric element 58 is used as an ink ejection force generating device which causes ink to be ejected from the nozzle 51 provided in the head 50, but it is also possible to employ a thermal method in which a heater is provided inside the pressure chamber 52 and ink is ejected by using the pressure of the film boiling action caused by the heating action of this heater.

As illustrated in FIG. 3B, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which the ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the example shown in the drawings, and it is also possible to apply various other types of nozzle arrangements, such as an arrangement structure having one nozzle row in the sub-scanning direction.

Furthermore, the scope of application of the present invention is not limited to a printing system based on a line type of head, and it is also possible to adopt a serial system where a short head which is shorter than the breadthways dimension of the recording paper 16 is scanned in the breadthways direction (main scanning direction) of the recording paper 16, thereby performing printing in the breadthways direction, and when one printing action in the breadthways direction has been completed, the recording paper 16 is moved through a prescribed amount in the direction perpendicular to the breadthways direction (the sub-scanning direction), printing in the breadthways direction of the recording paper 16 is carried out in the next printing region, and by repeating this sequence, printing is performed over the whole surface of the printing region of the recording paper 16.

Method of Forming Organic Film

Next, the method of forming the organic film according to the present embodiment is described. FIGS. 5A to 5D are step diagrams for describing the organic film forming method. Here, a case is described in which an organic film 110 (corresponding to the organic film 62 in FIG. 4) is formed on the surface (ink ejection surface side) of a base member 100 (corresponding to the nozzle plate 60 in FIG. 4) as shown in FIG. 5D.

The method of forming the organic film according to the present embodiment includes: pre-treatment steps including (1) a plasma treatment step of carrying out plasma treatment on the surface of the base member, (2) an exposure processing step of exposing the surface of the base member that has undergone the plasma treatment, in an atmosphere containing at least water, and (3) a dehydration processing step of dehydrating the surface of the base member; and (4) an organic film formation step of forming an organic film from a silane coupling agent on the surface of the base member. The dehydration processing step should be carried out as and where necessary, and can be omitted. The respective steps are described in more detail below.

<Pre-Treatment Steps>

(1) Plasma Treatment Step

Figure 5A:
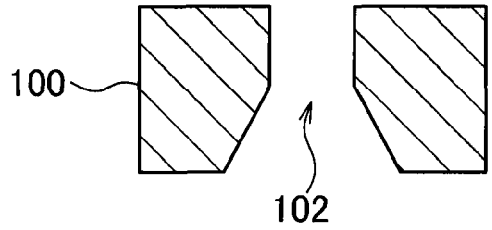
FIGS. 5A to 5D are step diagrams for describing a method of forming an organic film according to an embodiment of the present invention.
Figure 5B:
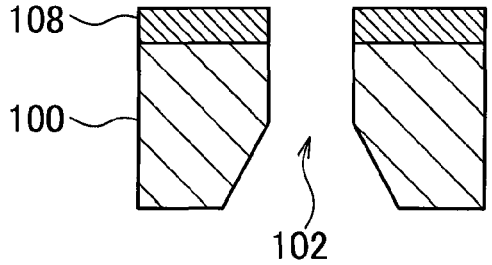

The plasma treatment step is a step for carrying out a plasma treatment onto the surface of the base member 100, to remove contamination such as organic material on the surface of the base member 100, and also forming dangling bonds and an oxide layer 108, as shown in FIGS. 5A and 5B.

The base member 100 can be made of metal, organic material, inorganic material, or the like. Although there are no particular restrictions on the material of which the base member 100 is made, it is desirable that the surface of the base member 100 where an organic film (a liquid-repellent film) is to be formed is covered with a layer containing at least silicon. By forming the layer containing silicon, it is possible to strengthen the adhesion with the silane coupling agent. It is also desirable that the surface of the base member 100 is covered with a natural oxide film, an oxide film formed by CVD or the like, a thermal oxide film, and the like.

The plasma treatment is carried out by introducing the base member 100 into a plasma treatment apparatus. For the gas supplied into the plasma treatment apparatus, it is desirable to use a gas or a mixed gas containing at least one of: $O_2$, rare gases (Ar, Ne, He, Kr, Xe, etc.), $H_2$, $N_2$ and $CF_4$.

The plasma treatment conditions vary with the structure of the chamber of the plasma treatment apparatus used, and the material of the base member 100. The conditions when using a CVD apparatus made by YES (YES-1224P), for example, are as indicated below:

Plasma treatment using Ar gas (99.99% or above): gas flow volume=10 to 50 sccm, plasma output=100 to 800 W, processing time=1 to 60 minutes; or Plasma treatment using $O_2$+Ar mixed gas: mixed gas flow rate=10 to 50 sccm (desirably, $O_2$: Ar=25 sccm:5 sccm), plasma output=100 to 800 W, processing time=1 to 60 minutes.

(2) Exposure Processing Step

Figure 5C:
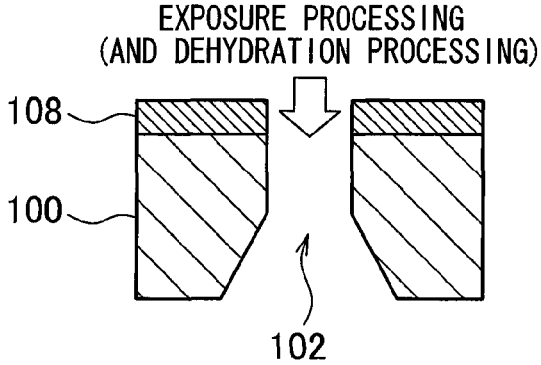
Figure 5D:
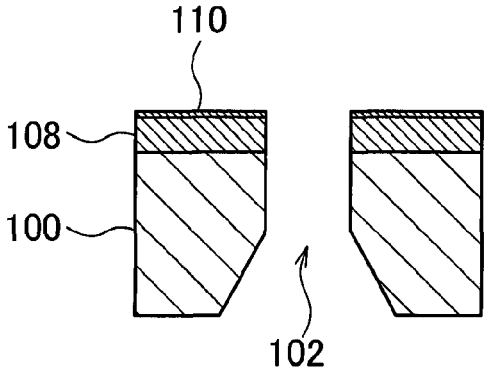

After the plasma treatment step, the exposure processing of the base member 100 is carried out in an atmosphere containing at least water, as shown in FIG. 5C.

In the exposure processing step, it is possible to carry out processing for a processing time of 1 to 60 min, at the relative humidity of 1 to 100%, in a temperature-controllable thermostatic chamber. It is desirable that the relative humidity is 60% or above and the processing time is approximately 10 minutes.

Furthermore, in order to prevent contamination of the dangling bonds and the surface of the oxide layer 108, it is desirable to carry out the plasma treatment step and the exposure processing step in the same apparatus. For example, by using the YES CVD apparatus (YES-1224P) as described above, these steps can be carried out inside the same chamber. In this case, it is possible to carry out processing in an atmosphere obtained by setting the base pressure to 0.5 Torr, and evaporating 0.2 ml of water into air at a chamber temperature of 140° C.

By carrying out the exposure processing step, it is possible to form a large number of hydroxyl groups (OH groups) which create reaction sites for the silane coupling agent, on the dangling bonds and the surface of the oxide layer 108.

The foregoing describes the composition where water vapor is included in the gas atmosphere; however, it is also possible to carry out the exposure processing step by a method of immersing the base member 100 in water. When the exposure processing step is carried out by immersion of the base member 100 in water, it is possible to immerse the base member 100 in pure water, and desirably, ultra-pure water, at a temperature between the room temperature and 100° C. or higher.

(3) Dehydration Processing Step

After carrying out the exposure processing step, if there is excessive water left on the dangling bonds and the surface of the oxide layer 108, then there may be cases where the silane coupling agent and the dangling bonds and the oxide layer 108 do not form siloxane bonds or form extremely instable bonds (hydrogen bonds) having weak bonding force. If the bonds between the silane coupling agent and the dangling bonds and oxide layer 108 are weak, then the alkali resistance declines, which is not desirable. Hence, if excessive water is left on the dangling bonds and the surface of the oxide layer 108, it is desirable to carry out the dehydration processing step as shown in FIG. 5C.

The dehydration processing step can be carried out by purging with a gas, baking, or the like. The purging is carried out by supplying a gas to the interior of the chamber. The gas supplied can be air, or the like; and it is desirable to supply an inert gas ($N_2$ or a rare gas such as He, Ar, Ne, Kr or Xe) during purging while taking account of contamination and the effects on the base member 100, the dangling bonds and the oxide layer 108. It is also desirable that the purging is carried out a plurality of times, and by disposing a vapor sensor inside the processing chamber, it is possible to confirm the number of purging operations required to remove the water on the dangling bonds and the oxide layer 108, from the residual amount of water inside the chamber.

Furthermore, the dehydration processing step can also involve the baking process. The baking process can be carried out by disposing the base member 100 inside a thermostatic chamber set to the room temperature or higher. The temperature in the baking process is desirably 40° C. or higher, more desirably 60° C. or higher, and even more desirably 100° C. or higher. As an upper temperature limit, if the base member 100 is made of silicon only, then it is possible to carry out the baking process at 1000° C. or higher, and desirably at a temperature of not higher than 1100° C. If the base member 100 is one including adhesive, piezoelectric bodies, or the like, then it is desirable to carry out the baking process at 300° C. or lower and preferably, 200° C. or lower. If the baking process is carried out at high temperature, then the baking process can be completed in a short period of time. The baking process time may be from one minute to 24 hours.

If the dehydration processing step is carried out in the same chamber as the chamber where the exposure processing step is carried out, then it is possible to reduce contamination, and furthermore, the dehydration processing step can also involve carrying out a purging process and then carrying out a baking process.

As described previously, the dehydration processing step can be omitted, provided that no water is left on the surface of the base member 100.

<Organic Film Formation Step>

(4) Organic Film Formation Step (4A) Method of Direct Forming on the Base Member After the exposure processing step or the dehydration processing step, the organic film 110 is formed by a silane coupling agent, as shown in FIG. 5D. Since a large number of hydroxyl groups (OH groups) creating reaction sites for the silane coupling agent have been formed on the dangling bonds and the surface of the oxide layer 108 in the exposure processing step, then in the organic film formation step, the silane coupling agent bonds at high density with the dangling bonds and the oxide layer 108, and the organic film of high density can be formed. Consequently, it is possible to impart high resistance with respect to alkalis.

The silane coupling agent is a silicon compound represented by $Y_nSiX_{4-n}$ (n=1, 2, 3), where Y includes a relatively inert group, such as an alkyl group, or a reactive group, such as a vinyl group, an amino group, or an epoxy group; and X includes a group that can be bonded to a hydroxyl group or adsorption water on the substrate surface by condensation, such as a halogen, a methoxy group, an ethoxy group or an acetoxy group. A silane coupling agent is widely used in the manufacture of composite materials constituted of an organic material and an inorganic material, such as glass fiber-reinforced plastics, in order to mediate in the bonds between the materials. If Y is an inert group, such as an alkyl group, then adherence to or abrasion of the modified surface is prevented and characteristics such as sustained gloss, water-repellent properties, lubricating properties, and the like, are imparted to the surface. If Y includes a reactive group, then this is used principally to improve adhesiveness. Moreover, a surface that has been modified by using a fluorine type silane coupling agent having a carbon fluoride straight-chain introduced in Y has low surface free energy, like the surface of PTFE (polytetrafluoroethylene), and hence the characteristics, such as water-repellent properties, lubricating properties, mold separation, and the like, are improved, and oil-repelling properties are also displayed.

In the present embodiment, an organic film having liquid-repellent properties is formed with a fluorine type silane coupling agent (chlorine type, methoxy type, ethoxy type, isocyanate type, or the like). For the liquid-repellent film, it is possible to use a metal alkoxide liquid-repellent film, a silicone liquid-repellent film, a fluorine-containing liquid-repellent film or the like, which is formed by a dry process, such as a physical vapor epitaxy method (vapor deposition method, sputtering method, or the like), or a chemical vapor epitaxy method (CVD method, ALD method, or the like), or a wet process, such as sol gelation, an application method, or the like (commercially available fluorine-containing liquid-repellent films include Cytop manufactured by Asahi Glass or NANOS manufactured by T&K, which have superior adhesiveness to the silicon base member, and a film which is capable of siloxane bonding and has a CF group on the film surface, such as the silane coupling agent sold by Gelest, is also suitable).

(4B) Method of Forming on Plasma Polymerization Film

Figure 6A:
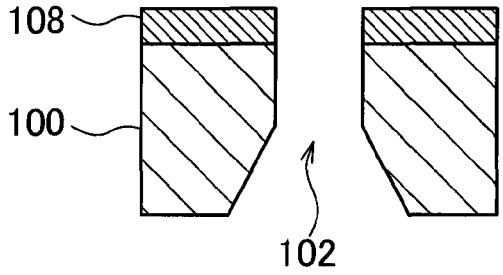
FIGS. 6A to 6C are step diagrams for describing a method of forming an organic film according to another embodiment of the present invention.
Figure 6B:
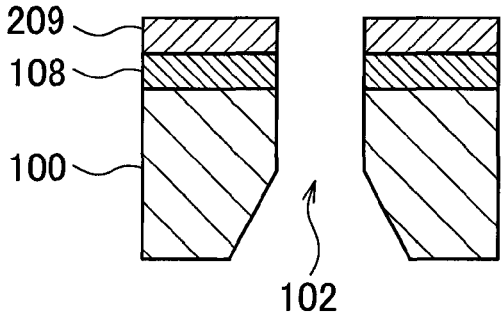
Figure 6C:
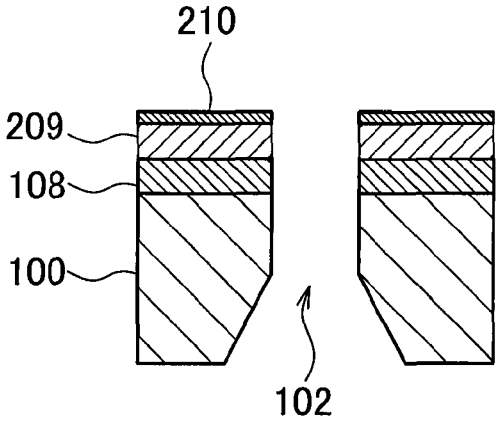

FIGS. 6A to 6C show step diagrams for describing a method of forming the organic film 108 onto a plasma polymerization film 209 on the base member 100. The method of forming the organic film includes: (4B-1) an intermediate layer formation step of forming an intermediate layer constituted of a plasma polymerization film on the surface of the base member, (4B-2) an oxidization processing step of carrying out oxidization of the intermediate layer (plasma polymerization film) formed on the surface of the base member, and (4B-3) an organic film formation step of forming the organic film on the surface of the intermediate layer that has undergone oxidization.

(4B-1) Intermediate Layer Formation Step

When forming the organic film on the plasma polymerization film, firstly, the intermediate layer 209 (FIG. 6B) constituted of a plasma polymerization film is deposited on the dangling bonds and the surface of the oxide layer 108 (FIG. 6A) on the base member 100 that has completed a pre-processing step.

For the material constituting the intermediate layer (plasma polymerization film) 209 and the forming method (film forming method), it is desirable to use the materials and method described in Japanese Patent Application Publication No. 2008-105231.

More specifically, possible examples of the constituent material of the intermediate layer 209 are: silicone materials such as organopolysiloxane, or silane compounds such as alkoxysilane, or the like. Of these, silicone materials are desirable, and organopolysiloxane is particularly desirable. By using organopolysiloxane in the intermediate layer 209, a structure having a framework of siloxane bonds (Si—O) is obtained, and therefore easy bonding with the constituent material (silicon material, or the like) of the base member 100 is achieved, and the plasma polymerization film can be formed readily.

Of organopolysiloxanes, it is desirable to use alkyl polysiloxane. Since alkyl polysiloxane is a polymer compound, then it is possible to form a polymer film on the base member 100. Since each polymer molecule includes an alkyl group, then there are few steric constraints on the polymer structure and a film having regularly ordered molecules can be formed. Moreover, of alkyl polysiloxanes, dimethyl polysiloxane is particularly desirable. Dimethyl polysiloxane is easy to manufacture and therefore can be procured readily. It has high reactivity and therefore methyl groups can be severed easily when an oxidization process such as that described below is applied to the intermediate layer 209.

The method of forming the intermediate layer (plasma polymerization film) 209 may be plasma polymerization, vapor deposition, processing with a silane coupling agent, a process employing a liquid material containing polyorganosiloxane, or the like, and one or more of these methods may be used in combination.

Of these methods, using a plasma polymerization method is preferable. By using plasma polymerization, a plasma of organopolysiloxane is created, and it is then possible to form the intermediate layer (plasma polymerization film) 209 of uniform properties and uniform thickness.

(4B-2) Oxidization Processing Step

Next, the oxidization processing step is carried out on the surface of the intermediate layer (plasma polymerization film) 209 in a process gas atmosphere having a dew point of −40° C. to 20° C., desirably −40° C. to −20° C., so that hydroxyl groups and/or adsorption water is introduced.

For the conditions relating to the process gas and the method of the oxidization process, and the like, it is desirable to use the conditions, method, and the like, described in Japanese Patent Application Publication No. 2008-105231.

More specifically, as the oxidization processing method, it is possible to employ a method which irradiates a beam of energy, such as ultraviolet light or plasma. According to this method, it is possible to carry out an oxidization process only in the region that is irradiated with the energy beam, and therefore $SiO_2$ can be formed efficiently.

In particular, in the present embodiment, of methods which irradiate an energy beam, a method which carries out an oxidization process using plasma irradiation is preferable. When plasma irradiation is used as the oxidization process, possible examples of a gas generating the plasma are: oxygen gas, nitrogen gas, hydrogen gas or inert gas (argon gas, helium gas, or the like), and it is possible to use to one or more of these gases.

The atmosphere in which plasma irradiation is carried out may be either at atmospheric pressure or reduced pressure, and atmospheric pressure is desirable. By this means, oxygen atoms are introduced efficiently from oxygen molecules present in the atmosphere, virtually at the same time as the severing of the bonds between alkyl groups and silicon, and therefore polyorganosiloxane can be changed more rapidly into $SiO_2$.

In particular, in plasma irradiation, it is desirable to use oxygen plasma irradiation employing a gas containing oxygen as the gas that generates the plasma. If oxygen plasma irradiation is used, oxygen plasma severs the bonds between alkyl groups and silicon, as well as being used to bond silicon as oxygen atoms, and therefore it is possible to change polyorganosiloxane into $SiO_2$ more reliably.

The plasma irradiation can be carried out either under closed conditions (for example, in a chamber) or open conditions, and closed conditions are desirable. By this means, the intermediate layer (plasma polymerization film) 209 is oxidized in a state of higher plasma density and therefore it is possible to introduce a greater number of hydroxyl groups into the intermediate layer (plasma polymerization film) 209.

(4B-3) Organic Film Formation Step

Next, as shown in FIG. 6C, the organic film 210 is formed on the surface of the intermediate layer (plasma polymerization film) 209 that has undergone the oxidization process.

There are no particular restrictions on the organic film 210, provided that it can form siloxane bonds with the intermediate layer (plasma polymerization film) 209, and it is possible to employ a metal alkoxide liquid-repellent film, a fluorine-containing plasma polymerization film, a silicone plasma polymerization liquid-repellent film, or the like, and of these, a plasma polymerization film, such as a fluorine-containing plasma polymerization film, a silicone plasma polymerization liquid-repellent film, or the like, is especially desirable.

As the method of forming the organic film constituted of a plasma polymerization film, it is desirable to use a method described in Japanese Patent Application Publication No. 2004-106203. That is, it is possible to form the plasma polymerization film (organic film) by using a known plasma treatment apparatus. For the raw material of the organic film, a gas formed by vaporizing a low-molecular-weight siloxane, such as a liquid siloxane, is used. According to requirements, a rare gas, such as argon or helium, or a gas having oxidizing power, such as oxygen or carbon dioxide, or the like, is mixed with this raw material gas. By this means, it is possible to layer the raw material on the base member 100 in a polymerized state.

As stated above, the organic film constituted of a plasma polymerization film is formed by taking a low-molecular-weight siloxane (a compound having a siloxane bond) as a raw material and carrying out plasma polymerization of this raw material, and the organic film has excellent resistance to metal salts and is extremely suitable as a liquid-repellent layer of a nozzle plate for aqueous pre-treatment liquid (metal salt solution) that contains a metal salt as an ink aggregating agent.

As the method of forming the metal alkoxide liquid-repellent film, it is desirable to use a method described in Japanese Patent Application Publication No. 2008-105231. More specifically, it is possible to use processes of various types, such as a liquid phase process or a gas phase process, and of these, it is desirable to use a liquid phase process, whereby an organic film constituted of a metal alkoxide can be formed by means of a relatively simple process.

As described above, the oxidization process (and desirably, oxidization by plasma irradiation) is performed on the intermediate layer (plasma polymerization film) 209 formed on the surface of the base member 100, hydroxyl groups and/or adsorption water is introduced, and the organic film 210 is formed on the intermediate layer 209 that has undergone oxidization. Thus, it is possible to form the uniform organic film 210 having high adhesiveness and excellent wear resistance on the surface side of the base member 100.

Consequently, it is possible to improve ink ejection performance and reliability which are important factors in an inkjet head, and improvement in image quality can be achieved.

(4C) Method of Forming Step Structure

The method of forming the organic film shown in FIGS. 7A to 7I is includes: (4C-1) a step of forming a first plasma polymerization film 304 on the surface of the base member 100, dangling bonds and the oxide layer 108 that have undergone the pre-treatment step (FIG. 7A) (first plasma polymerization film formation step); (4C-2) a step of carrying out hydrogen plasma treatment to the first plasma polymerization film 304 (hydrogen plasma treatment step); (4C-3) a step of forming a second plasma polymerization film 306 on the first plasma polymerization film 304 (second plasma polymerization film formation step); (4C-4) a step of forming a mask 308 on the second plasma polymerization film 306 (mask formation step); (4C-5) a step of carrying out an oxidization process (or etching process) on the second plasma polymerization film 306 using the mask 308 (step formation step); (4C-6) a step of removing the mask 308 (mask removal step); (4C-7) a step of carrying out an oxidization process on the surfaces (liquid-repellent film formation surfaces) of the first and second plasma polymerization films 304 and 306 (oxidization processing step); and [4C-8] a step of forming an organic film 320 on the surfaces of the first and second plasma polymerization films 304 and 306 which have undergone the oxidization processing (organic film formation step).

(4C-1) First Plasma Polymerization Film Formation Step

Figure 7A:
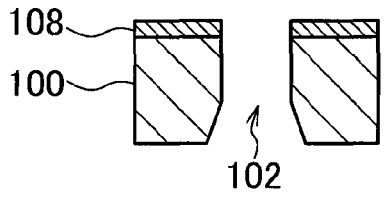
FIGS. 7A to 7I are step diagrams for describing a method of forming an organic film according to yet another embodiment of the present invention.
Figure 7B:
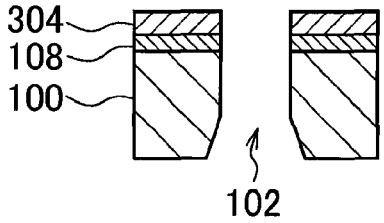

Firstly, as shown in FIG. 7B, the first plasma polymerization film 304 is formed on the base member 100, the dangling bonds and the oxide layer 108 which have completed the pre-processing step. The first plasma film formation step can be carried out using a similar method to that of the intermediate layer formation step (4B-1).

(4C-2) Hydrogen Plasma Treatment Step

Figure 7C:
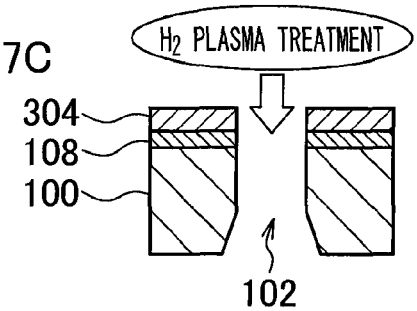

Next, as shown in FIG. 7C, hydrogen plasma treatment is carried out onto the first plasma polymerization film 304, thereby improving the plasma resistance of the first plasma polymerization film 304. By this means, the first plasma polymerization film 304 is able to function as an etching stop layer in the oxidization process (or etching process) carried out in the step formation step, which is performed subsequently.

The following three types of methods can be used for the hydrogen plasma treatment:

(1) Irradiation of $H_2$ plasma;

(2) Irradiation of plasma of process gas containing $H_2$ and inert gas; and (3) Irradiation of plasma of process gas containing substance including hydrogen and inert gas.

As regards the conditions of $H_2$ plasma irradiation, $H_2$ is supplied to the chamber and the internal pressure of the chamber is set to a prescribed value, desirably no greater than 13.3 Pa (100 mTorr), for instance, a pressure of 6.7 Pa (50 mTorr). In this state, high-frequency power is applied to the electrodes, the process gas is converted into a plasma, and $H_2$ plasma is irradiated onto the plasma polymerization film.

Although the detailed mechanism of improving plasma resistance is not necessarily clear, it is thought that the plasma containing H promotes a cross-linking reaction in the first plasma polymerization film 304 and changes C—O bonds and C—H bonds to C—C bonds, thereby strengthening the chemical bonds and improving the resistance to plasma. The substance including hydrogen is desirably $H_2$ or $NH_3$, due to ease of handling. For example, it is possible to improve the plasma resistance of the first plasma polymerization film 304 by means of a hydrogen plasma process using $H_2$+$N_2$ process gas.

(4C-3) Second Plasma Polymerization Film Formation Step

Figure 7D:
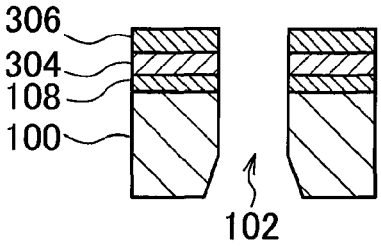

Next, as shown in FIG. 7D, the second plasma polymerization film 306 is formed on the first plasma polymerization film 304 that has undergone the hydrogen plasma treatment.

In this step, the material used as the constituent material of the second plasma polymerization film 306 is the same as the constituent material of the above-described first plasma polymerization film 304. By layering the plasma polymerization films 304 and 306 made of the same material, it is possible to maintain a state of high adhesiveness between the plasma polymerization films.

There are no particular restrictions on the methods of forming the second plasma polymerization film 306, and desirably the methods are the same as the methods for forming the first plasma polymerization film 304 described above, and of these methods, the plasma polymerization is preferable.

(4C-4) Mask Formation Step

Figure 7E:
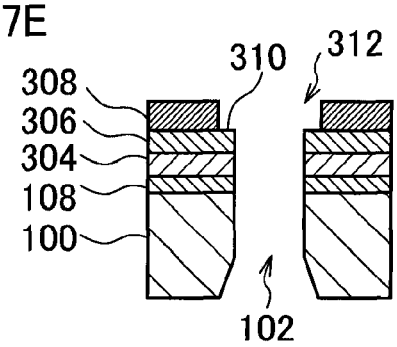

Next, as shown in FIG. 7E, the mask 308 having a prescribed pattern is formed on the second plasma polymerization film 306.

The mask 308 has an opening section 312 of a prescribed shape that encompasses an outer perimeter portion 310, which corresponds to the outer perimeter of the nozzle hole 102, in the second plasma polymerization film 306. In other words, a structure is adopted in which the outer perimeter portion 310 of the second plasma polymerization film 306 is not covered with the mask 308, but rather is exposed through the opening section 312.

In the embodiment depicted in the drawings, the mask 308 has the opening sections 312 at positions corresponding to the nozzle holes 102, and each opening section 312 has a circular shape which has a larger diameter than the inner diameter of the nozzle hole 102. The shape of the opening section 312 in the mask 308 is not limited in particular provided that it is a shape whereby at least the outer perimeter portion 310 of the nozzle hole 102 in the second plasma polymerization film 306 is exposed, and it may be a shape that encompasses the outer perimeter portions 310 corresponding to a plurality of nozzle holes 102 (for example, a band shape, or the like).

There are no particular restrictions on the constituent material of the mask 308, provided that it has resistance to the oxidization process (or the etching process) which is carried out in the step formation step that is performed subsequently, in other words, provided that it has a function of shielding the energy beam that is irradiated in the subsequent process; for example, the material of the mask may be a metal, such as aluminum, glass (having a function of shielding ultraviolet light), ceramics of various kinds, silicone, or the like.

Furthermore, the method of forming the mask 308 is not limited in particular, and it is possible, for example, to apply a plate-shaped mask 308 having opening sections 312 on the second plasma polymerization film 306. More specifically, the outer perimeter portions 310 and the opening sections 312 of the mask 308 are registered in such a manner that the outer perimeter portions 310 of the nozzle holes 102 in the second plasma polymerization film 306 are exposed, and the mask 308 is then bonded onto the second plasma polymerization film 306. As other forming methods, it is possible to use vapor deposition or photolithography, or the like.

By registering the outer perimeter portions 310 and the opening sections 312 as described above and disposing the mask 308 on the second plasma polymerization film 306, it is possible to carry out selective oxidization processing of the outer perimeter portions 310 which are exposed through the opening sections 312.

(4C-5) Step Formation Step

Figure 7F:
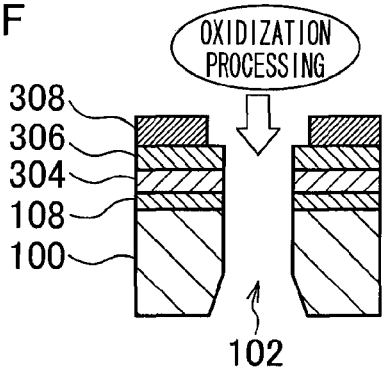
Figure 7G:
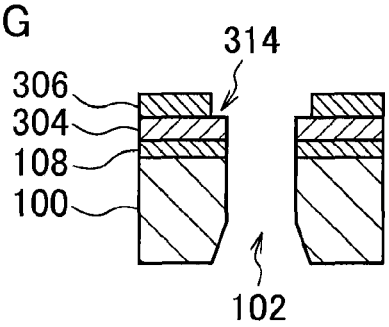

Next, as shown in FIG. 7F, oxidization processing is carried out on the second plasma polymerization film 306 that has been covered with the mask 308, the outer perimeter portion 310 of the second plasma polymerization film 306 is removed and a step structure 314 having a larger diameter than the nozzle hole 102 is formed in the periphery of the opening of the nozzle hole 102 (see FIG. 7G).

When the plasma polymerization film is subjected to oxidization processing, the thickness of the plasma polymerization film is reduced in the portion where oxidization has been carried out, as described in Japanese Patent Application Publication No. 2008-105231. In the present embodiment, these characteristics are used in order to remove selectively the portion that is exposed through the opening section 312 of the mask 308 (in other words, the outer perimeter portion 310 of the second plasma polymerization film 306). The oxidization process can be carried out using a method similar to that of the above-described oxidization processing step (4B-2).

When the oxidization process is carried out on the second plasma polymerization film 306, then due to the function of the mask 308 described above, the portion of the second plasma polymerization film 306 directly below the opening section 312 of the mask 308, in other words, only the outer perimeter portion 310, undergoes the oxidization process selectively. Thereby, alkyl groups terminating the surface in the portion 310 are severed from silicon atoms and $SiO_2$ is formed. The second plasma polymerization film 306 situated inside the opening section 312, in other words, the second plasma polymerization film 306 in the outer perimeter portion 310, is reduced in thickness. In this case, since the first plasma polymerization film 304, which has enhanced plasma resistance due to the hydrogen plasma treatment, functions as an etching stop layer, then the portion of the second plasma polymerization film 306 that is not covered with the mask 308 (in other words, the outer perimeter portion 310) is removed completely and the step structure 314 having a larger diameter than the nozzle hole 102 is formed in the periphery of the opening of the nozzle hole 102. Thus, it is possible to form the step structures 314 showing little variation around the nozzle holes 102, and therefore ejection stability and maintenance properties can be improved.

In the present embodiment, although the oxidization process has been described as the method of removing the outer perimeter portion 310 of the second plasma polymerization film 306, it is also possible to use an etching process instead of the oxidization process.

(4C-6) Mask Removal Step

Next, as shown in FIG. 7G, the mask 308 is removed from the second plasma polymerization film 306.

The method of removing the mask 308 differs according to the type (forming method) of the mask 308. If using the plate-shaped mask 308, for example, it is possible to remove the mask 308 by separation from the second plasma polymerization film 306. If the mask 308 has been formed by vapor deposition or photolithography, or the like, then it is possible to remove the mask 308 by a method of exposing the mask 308 to an oxygen plasma or ozone vapor at atmospheric pressure or reduced pressure, or a method of immersing the mask 308 in a dissolving solution or a separating solution.

(4C-7) Oxidization Processing Step

Figure 7H:
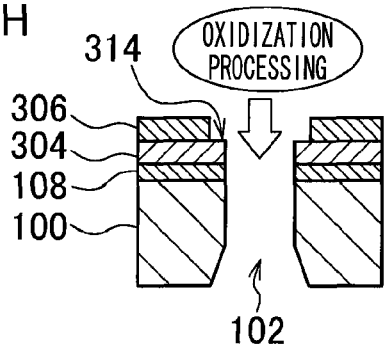

Thereupon, as shown in FIG. 7H, the oxidization processing is carried out onto the surfaces of the plasma polymerization films 304 and 306 (the organic film formation surfaces) which constitute the step structure 314. More specifically, the oxidization process is carried out onto the surfaces of the plasma polymerization films 304 and 306 in a processing gas atmosphere having a dew point of −40° C. to 20° C., desirably −40° C. to −20° C., and hydroxyl groups and/or adsorption water is introduced. Thereby, it is possible to improve the adhesiveness between the liquid-repellent film that is formed in a subsequent step and the plasma polymerization films 304 and 306. The oxidization process can be carried out using a method similar to that of the above-described oxidization processing step (4B-2).

(4C-8) Organic Film Formation Step

Figure 7I:
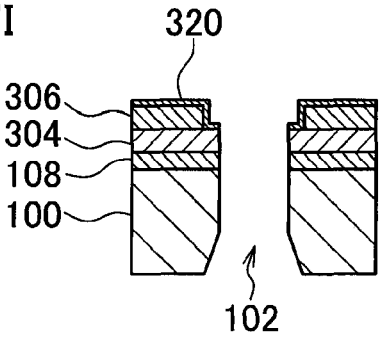

Next, as shown in FIG. 7I, the organic film 320 is formed on the surfaces of the plasma polymerization films 304 and 306 (the organic film formation surfaces) which have undergone the oxidization processing.

There are no particular restrictions on the organic film 320, provided that it can form siloxane bonds with the plasma polymerization films 304 and 306; for example, it is possible to employ a metal alkoxide liquid-repellent film, a fluorine-containing plasma polymerization film, a silicone plasma polymerization liquid-repellent film, or the like, and of these, a plasma polymerization film, such as a fluorine-containing plasma polymerization film, a silicone plasma polymerization liquid-repellent film, or the like, is especially desirable. The organic film formation process can be carried out using a method similar to that of the above-described organic film formation step (4B-3).

The organic film forming methods according to the embodiments of the present invention have been described with reference to the example where an organic film is formed on a nozzle forming substrate as the base member 100; however, the present invention is not limited to this and can also be applied suitably to a case of forming an organic film on a base member (structural body) in which hole sections, such as ink flow channels, are formed.

The organic film forming method, nozzle plate, inkjet head and electronic device according to the embodiments of the present invention have been described in detail above; however, the present invention is not limited to the aforementioned embodiments, and it is of course possible for improvements or modifications of various kinds to be implemented, within a range which does not deviate from the essence of the present invention.

EXAMPLES

The present invention is described in more specific terms below with reference to practical examples; however, the present invention is not limited to these examples.

A fluorine-containing liquid-repellent film based on a silane coupling agent was formed by vapor deposition on a silicon base member and then immersed in an ink solution, and the angle of contact was measured with pure water to confirm the properties of the liquid-repellent film after a prescribed time period had elapsed.

Sample 1

Comparative Example

Film formation was carried out without performing preprocessing of the silicon base member.

Sample 2

Comparative Example

A film was formed on a silicon base member that had undergone $O_2$ plasma treatment (800 W, $O_2$ gas flow: 20 sccm, processing time: 10 minutes).

Sample 3

Practical Example

A film was formed on a silicon base member that had undergone Ar plasma treatment (300 W, Ar gas flow: 20 sccm), followed by water vapor exposure (vaporization of 0.2 ml of water in a 140° C. atmosphere), and dehydration processing (heating at 100° C. for 1 hour).

Sample 4

Practical Example

A film was formed by the same method as the sample 3, with the exception that nitrogen gas purging was carried out in the dehydration process instead of the heating in the sample 3.

<Inks>

The inks used for immersion were inks having the compositions indicated below. The pH of the ink was 9.0 in each of the ink compositions.

<<Composition of Ink 1>>
Cyan dispersion liquid 1: 3 wt % (by pigment concentration)
Resin particles dispersion P-2: 7 wt %
Sannix GP-250 (made by Sanyo Chemical Industries): 10 wt %
Tripropylene glycol monomethyl ether: 10 wt %
Olefin E1010 (surfactant made by Nisshin Chemicals): 1 wt %
Deionized water: Remainder
<<Composition of Ink 2>>
Cyan dispersion liquid 1: 2 wt % (by pigment concentration)
Resin particles dispersion P-2: 8 wt %
Sannix GP-250 (made by Sanyo Chemical Industries): 8 wt %
Tripropylene glycol monomethyl ether: 8 wt %
Olefin E1010 (surfactant made by Nisshin Chemicals): 1 wt %
Deionized water: Remainder
<<Composition of Ink 3>>
Cyan dispersion liquid 1: 4 wt % (by pigment concentration)
Resin particles dispersion P-2: 7 wt %
Sannix GP-250 (made by Sanyo Chemical Industries): 9 wt %
Tripropylene glycol monomethyl ether: 9 wt %
Olefin E1010 (surfactant made by Nisshin Chemicals): 1 wt %
Deionized water: Remainder

Experimental Results

Figure 8:
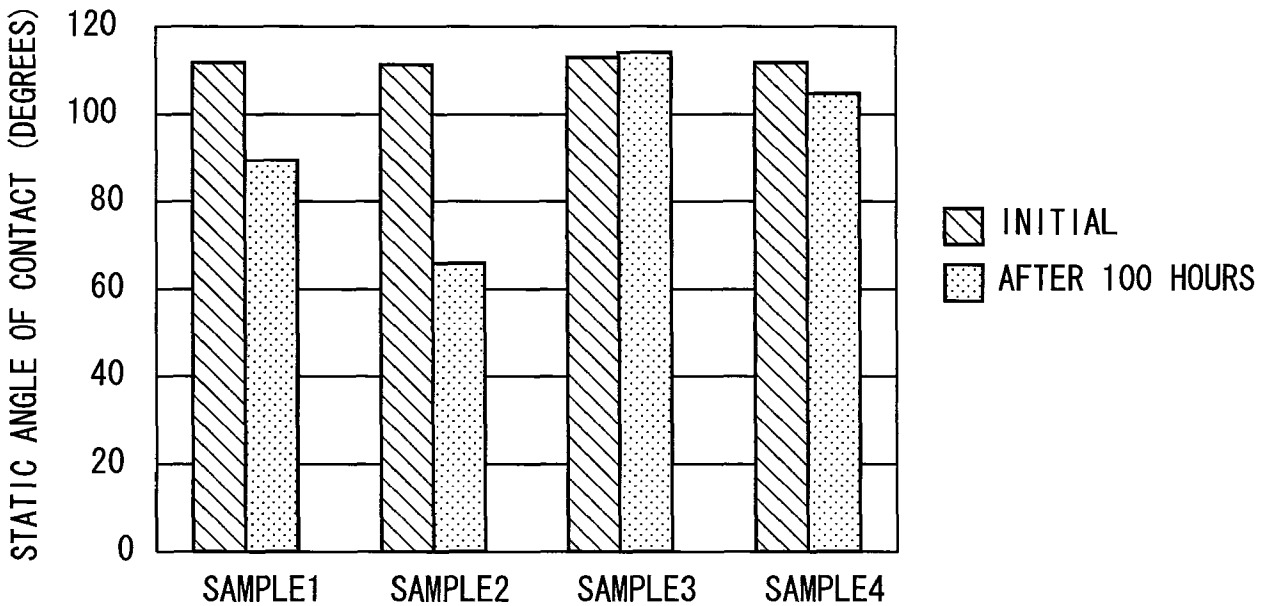
FIG. 8 is a graph showing experimental results.

The samples which had undergone the film formation were immersed in the respective inks and left in a thermostatic chamber set to 60° C., taken out after 100 hours and the static angle of contact was measured with pure water. FIG. 8 shows the results obtained with the ink 1.

As shown in FIG. 8, in each of the samples 1 and 2, the liquid-repellent properties declined after 100 hours' immersion in the ink, and anisotropic etching caused by alkali solution, which is characteristic of silicon, was observed in the surface. This was because the organic film was erased in alkali solution and silicon of the base member was etched.

On the other hand, in the sample 3, there was no change before and after immersion, no etching pits were seen upon observation with an optical microscope, and it was confirmed that the base member was completely covered and the high-density film was formed. Furthermore, the sample 4 also had high resistance to alkalis and provides beneficial effects in cases where it is not possible to apply high temperature as in the baking process.

Although the results are not shown, similar findings were observed for the inks 2 and 3 (having different content ratios than the ink 1) as well. Moreover, beneficial effects were also confirmed with respect to commercial water-soluble pigment-based ink. Furthermore, it is possible to improve the durability of the organic film formed by a silane coupling agent in respect of alkaline solutions, as well as pigment-based and dye-based inks.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of forming an organic film, comprising:

a pre-processing step including a plasma treatment step of carrying out plasma treatment to a surface of a base member, and an exposure processing step of exposing the surface of the base member that has undergone the plasma treatment, in an atmosphere containing at least water; and an organic film formation step of thereafter forming an organic film on the surface of the base member using a silane coupling agent.

2. The method as defined in claim 1, wherein in the exposure processing step, the surface of the base member is exposed in a water vapor atmosphere.

3. The method as defined in claim 1, wherein in the exposure processing step, the surface of the base member is immersed in water.

4. The method as defined in claim 1, wherein the pre-processing step further includes a dehydration processing step of dehydrating the surface of the base member, following the exposure processing step.

5. The method as defined in claim 4, wherein in the dehydration processing step, a purging process is carried out with a gas containing at least a rare gas.

6. The method as defined in claim 4, wherein in the dehydration processing step, a purging process is carried out with a gas containing at least $N_2$.

7. The method as defined in claim 4, wherein in the dehydration processing step, the surface of the base member is exposed in an atmosphere heated to a temperature not lower than 40° C.

8. The method as defined in claim 4, wherein in the dehydration processing step, the surface of the base member is exposed in an atmosphere heated to a temperature not lower than 60° C.

9. The method as defined in claim 4, wherein in the dehydration processing step, the surface of the base member is exposed in an atmosphere heated to a temperature not lower than 100° C.

10. The method as defined in claim 1, wherein the surface of the base member is composed of at least silicon.

11. The method as defined in claim 1, wherein in the plasma treatment step, the plasma treatment uses a reaction gas containing at least one of oxygen, a rare gas, hydrogen and nitrogen.

12. The method as defined in claim 1, wherein the organic film contains at least fluorine and has liquid-repellent properties.

13. The method as defined in claim 1, further comprising:

an intermediate layer formation step of forming an intermediate layer constituted of a plasma polymerization film on the surface of the base member, following the pre-processing step and before the organic film formation step, wherein in the organic film formation step, the organic film is formed on the intermediate layer on the surface of the base member.

14. The method as defined in claim 13, further comprising an oxidization processing step of carrying out oxidization of the intermediate layer, following the intermediate layer formation step and before the organic film formation step.

* * * * *